US011187406B2

(12) United States Patent
Andersson et al.

(10) Patent No.: US 11,187,406 B2
(45) Date of Patent: Nov. 30, 2021

(54) BED MANAGEMENT CYCLE FOR A FLUIDIZED BED BOILER AND CORRESPONDING ARRANGEMENT

(71) Applicant: Improbed AB, Malmo (SE)

(72) Inventors: Bengt-Ake Andersson, Molnlycke (SE); Pavleta Knutsson, Molndal (SE); Fredrik Lind, Torslanda (SE); Henrik Thunman, Partille (SE)

(73) Assignee: Improbed AB, Malmo (SE)

( * ) Notice: Subject to any disclaimer, the term of this patent is extended or adjusted under 35 U.S.C. 154(b) by 0 days.

(21) Appl. No.: 15/766,542

(22) PCT Filed: Nov. 7, 2016

(86) PCT No.: PCT/IB2016/056690

§ 371 (c)(1),
(2) Date: Apr. 6, 2018

(87) PCT Pub. No.: WO2017/060890

PCT Pub. Date: Apr. 13, 2017

(65) Prior Publication Data

US 2019/0072270 A1 Mar. 7, 2019

(30) Foreign Application Priority Data

Oct. 8, 2015 (EP) ..... 15189005

(51) Int. Cl.
*F23C 10/26* (2006.01)
*F23C 10/32* (2006.01)
(Continued)

(52) U.S. Cl.
CPC ..... *F23C 10/26* (2013.01); *F23C 10/00* (2013.01); *F23C 10/32* (2013.01); *C22B 1/10* (2013.01); *C22B 5/14* (2013.01); *F23C 2206/103* (2013.01)

(58) Field of Classification Search
CPC ..... F23C 10/26; F23C 2900/99008; F23C 99/00; F23C 13/00; F23C 10/005;
(Continued)

(56) References Cited

U.S. PATENT DOCUMENTS 3,801,514 A * 4/1974 Joseph ..... C01B 32/36 502/55
3,897,537 A 7/1975 Robinson et al.
(Continued)

FOREIGN PATENT DOCUMENTS

CA 2599564 9/2006
CN 101142329 3/2008
(Continued)

OTHER PUBLICATIONS

Moldenhauer et al., "Testing of minerals and industrial by-products as oxygen carriers for chemical-looping combustion in a circulating fluidized-bed 300W laboratory reactor" (Year: 2012).*
(Continued)

*Primary Examiner* — Jason Lau
(74) *Attorney, Agent, or Firm* — Casimir Jones, S.C.; Brian F. Bradley

(57) ABSTRACT

The invention relates to abed management cycle for a fluidized bed boiler, comprising the steps of: a) providing fresh ilmenite particles as bed material to the fluidized bed boiler; b) carrying out a fluidized bed combustion process; c) removing at least one ash stream comprising ilmenite particles from the fluidized bed boiler; d) separating ilmenite particles from the at least one ash stream; e) recirculating separated ilmenite particles into the bed of the fluidized bed boiler. The invention also relates to a corresponding arrangement for carrying out fluidized bed combustion, comprising a fluidized bed boiler comprising ilmenite particles as bed material; and a system for removing ash from the fluidized
(Continued)

Figure 1:
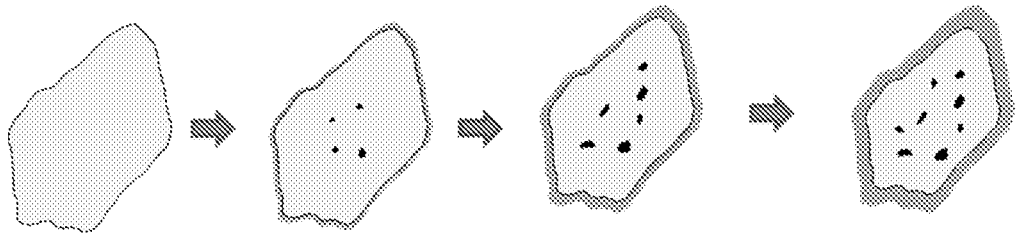

bed boiler; wherein the arrangement further comprises a separator for separating ilmenite particles from the re-moved ash; and means for recirculating separated ilmenite particles into the bed of the fluidized bed boiler.

23 Claims, 8 Drawing Sheets

(51) Int. Cl.

| | |
|---|---|
| ***F23C 10/00*** | (2006.01) |
| *C22B 1/10* | (2006.01) |
| *C22B 5/14* | (2006.01) |

(58) Field of Classification Search

CPC .... F23C 10/10; F23C 6/045; F23C 2201/101; F23C 6/047; F23C 10/01; F23C 6/04; F23C 13/08; F23C 9/00; F23C 9/003; F23C 9/006; F23C 2201/20; F23C 10/04; F23C 10/002; F23C 6/00; F23C 2202/20; F23C 7/008; F23C 2201/30; F23C 5/08; F23C 7/004; F23C 13/02; F23C 13/06; F23C 2900/06041; F23C 10/28; F23C 2900/1302; F23C 10/08; F23C 13/04; F23C 2202/30; F23C 2900/03005; F23C 7/00; F23C 10/20; F23C 10/24; F23C 2205/10; F23C 2205/20; F23C 2900/9901; F23C 5/32; F23C 7/02; F23C 10/22; F23C 2201/301; F23C 2900/03006; F23C 3/00; F23C 99/005; F23C 10/12; F23C 10/14; F23C 2202/40; F23C 2900/1003; F23C 3/002; F23C 3/006; F23C 5/00; F23C 6/042; F23C 7/002; F23C 99/003; F23C 2202/10; F23C 2206/101; F23C 2700/043; F23C 2900/03001; F23C 2900/03002; F23C 2900/09002; F23C 7/06; F23C 99/001; F23C 99/006; F23C 9/08; F23C 10/00; F23C 10/16; F23C 10/18; F23C 10/32; F23C 1/00; F23C 2201/102; F23C 2201/401; F23C 2202/50; F23C 2700/023; F23C 2700/026; F23C 3/008; F23C 7/006; F23C 7/08; F23C 10/02; F23C 1/02; F23C 1/08; F23C 1/12; F23C 2203/30; F23C 2700/04; F23C 2900/01001; F23C 2900/05081; F23C 2900/99001; F23C 2900/99006; F23C 5/28; F23C 9/06

See application file for complete search history.

(56) References Cited

U.S. PATENT DOCUMENTS

| | | | | | |
|---|---|---|---|---|---|
| 3,935,094 | A | | 1/1976 | Bergeron et al. | |
| 4,170,447 | A | * | 10/1979 | Goldstein | B03C 1/015 110/342 |
| 5,551,357 | A | * | 9/1996 | Wu | F23C 10/26 110/165 R |
| 5,575,086 | A | * | 11/1996 | Hartman | F23C 10/20 34/585 |
| 6,808,390 | B1 | * | 10/2004 | Fung | C10B 57/02 432/14 |
| 9,557,053 | B1 | * | 1/2017 | Siriwardane | B01J 23/002 |
| 2005/0175533 | A1 | * | 8/2005 | Thomas | C01B 3/063 423/657 |
| 2009/0000194 | A1 | * | 1/2009 | Fan | C01B 3/16 48/199 R |
| 2011/0281960 | A1 | * | 11/2011 | Tasaka | C10G 2/32 518/705 |
| 2012/0199054 | A1 | * | 8/2012 | Alban | F23C 10/00 110/267 |
| 2013/0181075 | A1 | * | 7/2013 | Pickens | B02C 23/14 241/14 |
| 2015/0204539 | A1 | * | 7/2015 | Hoteit | F23C 10/10 431/7 |

FOREIGN PATENT DOCUMENTS

| | | |
|---|---|---|
| CN | 102575842 | 7/2012 |
| CN | 102878552 | 1/2013 |
| DE | 102005012524 | 9/2006 |
| EP | 2762781 | 8/2014 |
| EP | 3153776 | 4/2017 |
| GB | 1431551 | 4/1976 |
| GB | 2070960 | 9/1981 |
| JP | S6365208 | 3/1988 |
| WO | 2012/051424 | 4/2012 |

OTHER PUBLICATIONS

Bale et al., FactSage thermochemical software and databases, Calphad, 2002, 26(2):189-228.

Corcoran, An analysis of ilmenite particles used as bed material for combustion of biomass in a CFB boiler, Master's Thesis in Sustainable Energy Systems, Chalmers University of Technology, Gothenburg, Sweden, 2013, T2013-397, 51 pages.

International Search Report and Written Opinion for PCT/IB2016/056690, dated Sep. 21, 2017, 14 pages.

Corcoran, A. et al. Ash Properties of Ilmenite Used as Bed Material for Combustion of Biomass in a Circulating Fluidized Bed Boiler, American Chemical Society, 2014, 7672-7679.

Bao, Jinhua, Investigation on Fe-based oxygen carriers in Chemical Looping Combustion with Coal as Fuel, Dissertation Submitted to Tsinghua University, Apr. 2014, 181 pages, English abstract included.

CN Decision of Rejection, CN Patent Application No. 2016800560405, dated May 24, 2021, 6 pages.

* cited by examiner

BED MANAGEMENT CYCLE FOR A FLUIDIZED BED BOILER AND CORRESPONDING ARRANGEMENT

The invention is in the field of fluidized bed combustion and relates to a bed management cycle for a fluidized bed boiler, such as a circulating fluidized bed boiler or a bubbling fluidized bed boiler and a corresponding arrangement for carrying out fluidized bed combustion.

Fluidized bed combustion is a well known technique, wherein the fuel is suspended in a hot fluidized bed of solid particulate material, typically silica sand and/or fuel ash. Other bed materials are also possible. In this technique, a fluidizing gas is passed with a specific fluidization velocity through a solid particulate bed material. The bed material serves as a mass and heat carrier to promote rapid mass and heat transfer. At very low gas velocities the bed remains static. Once the velocity of the fluidization gas rises above the minimum velocity, at which the force of the fluidization gas balances the gravity force acting on the particles, the solid bed material behaves in many ways similarly to a fluid and the bed is said to be fluidized. In bubbling fluidized bed (BFB) boilers, the fluidization gas is passed through the bed material to form bubbles in the bed, facilitating the transport of the gas through the bed material and allowing for a better control of the combustion conditions (better temperature and mixing control) when compared with grate combustion. In circulating fluidized bed (CFB) boilers the fluidization gas is passed through the bed material at a fluidization velocity where the majority of the particles are carried away by the fluidization gas stream. The particles are then separated from the gas stream, e.g., by means of a cyclone, and recirculated back into the furnace, usually via a loop seal. Usually oxygen containing gas, typically air or a mixture of air and recirculated flue gas, is used as the fluidizing gas (so called primary oxygen containing gas or primary air) and passed from below the bed, or from a lower part of the bed, through the bed material, thereby acting as a source of oxygen required for combustion. A fraction of the bed material fed to the combustor escapes from the boiler with the various ash streams leaving the boiler, in particular with the bottom ash. Removal of bottom ash, i.e. ash in the bed bottom, is generally a continuous process, which is carried out to remove alkali metals (Na, K) and coarse inorganic particles/lumps from the bed and any agglomerates formed during boiler operation, and to keep the differential pressure over the bed sufficient. In a typical bed management cycle, bed material lost with the various ash streams is replenished with fresh bed material.

From the prior art it is known to replace a fraction of the silica sand bed material with ilmenite particles in the CFB process (H. Thunman et al., Fuel 113 (2013) 300-309). Ilmenite is a naturally occurring mineral which consists mainly of iron titanium oxide ($FeTiO_3$) and can be repeatedly oxidized and reduced. Due to the reducing/oxidizing feature of ilmenite, the material can be used as oxygen carrier in fluidized bed combustion. The combustion process can be carried out at lower air-to-fuel ratios with the bed comprising ilmenite particles as compared with non-active bed materials, e.g., 100 wt.-% of silica sand or fuel ash particles.

The problem underlying the invention is to provide improved means for the management of bed material in a fluidized bed boiler.

This problem is solved by the features of the independent claims. Advantageous embodiments are defined in the dependent claims.

First, several terms are explained in the context of the invention.

The invention is directed to a bed management cycle for a fluidized bed boiler, comprising the steps of:

a) providing fresh ilmenite particles as bed material to the fluidized bed boiler;
b) carrying out a fluidized bed combustion process;
c) removing at least one ash stream comprising ilmenite particles from the fluidized bed boiler;
d) separating ilmenite particles from the at least one ash stream;
e) recirculating separated ilmenite particles into the bed of the fluidized bed boiler.

The invention has recognized that ilmenite particles can be conveniently separated from the boiler ash and that even after extended use as bed material in a fluidized bed boiler ilmenite still shows very good oxygen-carrying properties and reactivity towards oxidizing carbon monoxide (CO) into carbon dioxide ($CO_2$), so called "gas conversion" and good mechanical strength. In particular, the invention has recognized that the attrition rate of the ilmenite particles surprisingly decreases after an extended residence time in the boiler and that the mechanical strength is still very good after the ilmenite has been utilized as bed material for an extended period of time. This was surprising, since ilmenite particles, after having experienced an initial activation phase, undergo chemical aging as they are subjected to repeated redox-conditions during combustion in fluidized bed boilers and the physical interactions with the boiler structures induce mechanical wear on the ilmenite particles. It was therefore expected that the oxygen-carrying capacity of ilmenite particles and their attrition resistance rapidly deteriorate during the combustion process in a fluidized bed boiler.

The invention has recognized that in light of the good attrition resistance the surprisingly good oxygen-carrying properties of used ilmenite particles can be exploited by recirculating the separated ilmenite particles into the boiler bed. This reduces the need to feed fresh ilmenite to the boiler which in turn significantly reduces the overall consumption of the natural resource ilmenite and makes the combustion process more environmentally friendly and more economical. In addition, the separation of ilmenite from the ash and recirculation into the boiler allows for the control of the ilmenite concentration in the bed and eases operation. Furthermore, the inventive bed management cycle further increases the fuel flexibility by allowing to decouple the feeding rate of fresh ilmenite from the ash removal rate, in particular the bottom ash removal rate. Thus changes in the amount of ash within the fuel become less prominent since a higher bottom bed regeneration rate can be applied without the loss of ilmenite from the system.

The invention has further recognized that rock ilmenite particles exposed to the boiler conditions get smoother edges (compared to fresh ilmenite) and thereby a less erosive shape, which is less abrasive to boiler structures, such as walls, tube banks, etc. Therefore, recirculation of rock ilmenite particles into the boiler bed also improves the lifetime of these boiler structures.

The inventive bed management cycle comprises providing fresh ilmenite particles as bed material to the fluidized bed boiler. Preferably, the fresh ilmenite particles may be provided to the boiler at a predetermined feeding rate. In the context of the invention the term fresh ilmenite denotes ilmenite that has not yet been used as bed material in the boiler. The term fresh ilmenite comprises ilmenite that may have undergone an initial oxidation or activation process.

Advantageously, the fresh ilmenite particles may be provided as the sole bed material. In a preferred embodiment the bed consists essentially of ilmenite particles. In the context of the invention, the term consisting essentially of allows for the bed material containing a certain amount of fuel ash. In another preferred embodiment, the ilmenite particles may be provided as a fraction of the total bed material.

Preferably, the at least one ash stream is selected from the group consisting of bottom ash stream, fly ash stream, boiler ash stream and filter ash stream, preferably from the group consisting of bottom ash stream and fly ash stream. Most preferably the at least one ash stream is a bottom ash stream. In advantageous embodiments of the inventive bed management cycle, any combination of two or more ash streams is possible. Bottom ash is one of the major causes for the loss of bed material in fluidized bed boilers and in a particularly preferred embodiment the at least one ash stream is a bottom ash stream. Fly ash is that part of the ash, which is entrained from the fluidized bed by the gas and flies out from the furnace with the gas. Boiler ash is ash discharged from the boiler somewhere between the furnace and the flue gas cleaning filter. Filter ash is the ash discharged from the filter, which can normally be a bag house filter or an electrostatic precipitator (ESP). Other filters or separators are possible.

Preferably, the bed management cycle comprises separating the ilmenite particles by magnetic separation and/or electric separation.

The invention has recognized that the magnet attracting properties of ilmenite, which are increased by iron migration from the center to the surface of the particles, as the particles are exposed to altering redox conditions in a combustor during extended periods of time, allows for improved magnetic separation of ilmenite particles from the inert ash fraction.

Without wishing to be bound by theory, the following mechanism is contemplated. During use of the ilmenite as an oxygen carrier in the fluidized bed boiler, a natural segregation of the ilmenite phase to hematite is obtained by the outward migration of iron (Fe) and the formation of an Fe-rich shell around the particles. Fe-migration is a result of the diffusional processes that take place within the particles. In the ilmenite particle Fe and Ti tend to migrate towards regions high in oxygen potential, i.e. towards the surface of the particle. Iron diffuses outwards faster than titanium and at the surface it becomes oxidized. According to calculations using the program FactSage (Bale, C. W., et al., "FactSage thermochemical software and databases", Calphad, 2002, 26(2): p. 189-228) the end product after the oxidation of ilmenite is strongly influenced by temperature and oxygen potential. At temperatures above 850° C. and at high oxygen potential pseudo-brookite and hematite are the dominating phases, while at lower oxygen potential $FeTiO_3$ and $TiO_2$ are formed which would be the phases inside the particle. Further calculations on the stability of the pseudo-brookite ($Fe_2TiO_5$) phase show that upon segregation it changes to $Fe_2O_3$ and $TiO_2$ which is also the explanation of the homogeneous oxide phase formed at the edges of the particles. The process is stepwise and the thickness of the layer increases with the time of exposure, the so-called activation of the material. Since the magnetic susceptibility of the ilmenite particles increases with increasing Fe-migration to the surface of the particles, it is possible within the context of the described bed management cycle to separate ilmenite particles from the at least one ash stream based on their degree of activation, e.g. by using the magnetic susceptibility of the ilmenite particles as a proxy for their degree of activation and setting appropriate magnetic threshold levels.

Ilmenite is an electric semi-conductor and the invention has further recognized that it is also possible to separate the ilmenite particles from the ash stream by employing the semi-conductor properties of ilmenite. For example, the ilmenite particles can be electrically separated from the at least one ash stream, preferably by means of electrostatic separation.

Preferably, the bed management cycle comprises carrying out steps c), d) and e) multiple times. It is particularly preferred if steps c), d) and e) are carried out multiple times to provide for a continuous recirculation of separated ilmenite particles into the boiler.

A preferred embodiment of the bed management cycle comprises that the ilmenite particles are i) separated from the at least one ash stream; and/or ii) recirculated into the bed of the fluidized bed boiler;

based on their degree of activation. For example, it is possible to magnetically separate and/or select ilmenite particles for recirculation based on their magnetic susceptibility, using the magnetic susceptibility of the ilmenite particles as a proxy for their degree of activation.

In an advantageous embodiment of the bed management cycle all separated ilmenite particles are recirculated into the bed of the fluidized bed boiler. In another advantageous embodiment, a first fraction of the separated ilmenite particles is recirculated into the bed of the fluidized bed boiler, wherein preferably a second fraction of the separated ilmenite particles is discharged; wherein further preferably the first and second fractions are determined based on the degree of activation and/or the particle size of the ilmenite particles. The second fraction of the separated ilmenite particles may be discharged for use in further activities, e.g. in applications with a need for activated ilmenite particles, which may include the use of the discharged ilmenite particles in another boiler. Recirculation and discharge of the ilmenite particles may take place in parallel or in sequence and involve the same or different ash streams. For example, an advantageous embodiment comprises recirculating ilmenite particles separated from the bottom ash stream into the bed of the fluidized bed reactor, while ilmenite particles separated from the fly ash stream are discharged for further use in different applications. Preferably, recirculating and/or discharging the ilmenite particles can be based on their size and/or degree of activation.

Preferably, the bed management cycle may comprise an optional pre-selection step, in which the particles in the at least one ash stream are pre-selected before separating the ilmenite particles from the ash stream. Preferably the pre-selection comprises mechanical particle separation and/or fluid driven particle separation. A particularly preferred method for mechanical separation comprises sieving the particles. In fluid driven particle separation the particles are separated based on their fluid-dynamic behavior. A particularly preferred variant for fluid driven separation comprises gas driven particle separation. The pre-selection step described above can, e.g., be utilized to preselect particles in the ash stream based on the particle size and/or particle mass before further separating ilmenite particles from the pre-selected ash stream. This optional pre-selection step is particularly advantageous when the fluidized bed boiler is operated with a fuel type, such as, e.g., waste, which leads to a high ash content (so-called high ash fuel), e.g. 20-30 wt-% ash with respect to the total weight of the fuel.

The invention has recognized that the surprisingly good oxygen-carrying capacity and attrition resistance of ilmenite particles that have been exposed to boiler conditions for an extended period of time allow for average residence times of the ilmenite particles in the boiler which are at least a factor of 2.5 higher than typical residence times of bed material in conventional fluidized bed boilers. In preferred embodiments of the bed management cycle the average residence time of the ilmenite particles in the fluidized bed boiler is at least 75 hours, preferably at least 100 hours, further preferably at least 120 hours, further preferably at least 200 hours, further preferably at least 250 hours, further preferably at least 290 hours, most preferably at least 300 hours. Surprisingly, the invention has found that even after 296 hours of continuous operation in a fluidized bed boiler, ilmenite particles still show very good oxygen-carrying properties, gas conversion and mechanical strength, clearly indicating that even higher residence times are achievable.

In the context of the invention, the average residence time of the ilmenite particles in the boiler ($<T_{Res,ilmenite}>$) is defined as the ratio of the total mass of ilmenite in the bed inventory ($M_{ilmenite}$) to the product of the feeding rate of fresh ilmenite ($R_{feed,ilmenite}$) with the production rate of the boiler ($R_{production}$):

$$<T_{Res,ilmenite}>=M_{ilmenite}/(R_{feed,ilmenite}\times R_{Production})$$

By way of example, if the total mass of ilmenite in the boiler is 25 tons, the feeding rate of fresh ilmenite is 3 kg/MWh and the production rate is 75 MW, this gives the average residence time $<T_{Res,ilmenite}>=25/(3\times75/1000)$ hours=111 hours. Recirculation of separated ilmenite particles is a convenient way of extending the average residence time of the ilmenite particles in the boiler since the feeding rate for fresh ilmenite can be reduced.

In preferred embodiments, the average residence time of the ilmenite particles may be less than 600 hours, further preferably less than 500 hours, further preferably less than 400 hours, further preferably less than 350 hours. All combinations of stated lower and upper values for the average residence time are possible within the context of the invention and herewith explicitly disclosed.

Preferably, the bed management cycle may comprise decoupiing the feeding rate of fresh ilmenite particles from the ash removal rate, preferably from the bottom ash removal rate.

Preferably, the bed management cycle may comprise controlling the ilmenite concentration in the bed of the fluidized bed boiler. Advantageously, controlling the ilmenite concentration may comprise keeping the ilmenite concentration within a preferred concentration range. Any concentration range is possible. However, particularly preferred ilmenite concentrations in the bed are between 10 wt. % and 95 wt %, more preferably between 50 wt.-% and 95 wt. %, more preferably between 75 wt.-% and 95 wt.-%. Preferably, controlling the ilmenite concentration in the bed may comprise adjusting the ilmenite recirculation rate and/or the feeding rate of fresh ilmenite.

The invention is also directed to an arrangement for carrying out fluidized bed combustion, comprising a fluidized bed boiler; such as, e.g., a bubbling fluidized bed (BFB) boiler or a circulating fluidized bed (CFB) boiler; comprising ilmenite particles as bed material; and a system for removing ash from the fluidized bed boiler; wherein the arrangement further comprises a) a separator for separating ilmenite particles from the removed ash; and
b) means for recirculating separated ilmenite particles into the bed of the fluidized bed boiler.

The arrangement may be utilized to implement the bed management cycle described above. Preferably, the arrangement is configured to implement the bed management cycle described above.

Preferably the separator comprises a magnetic separator and/or an electric separator, wherein preferably the electric separator is an electrostatic separator. Advantageously, the magnetic separator may be configured to separate ilmenite particles from the removed ash based on their degree of activation, e.g. by using the magnetic susceptibility of the ilmenite particles as a proxy for their degree of activation and setting appropriate magnetic threshold levels.

Advantageously, the system for removing ash from the fluidized bed boiler may be configured to remove bottom ash and/or fly ash and/or boiler ash and/or filter ash. Preferably, the system for removing ash from the fluidized bed boiler may be configured to remove bottom ash and/or fly ash.

Preferably, the means for recirculating ilmenite particles are selected from the group consisting of pneumatic recirculation systems, mechanical recirculation systems and magnetic recirculation systems.

In preferred embodiments, the arrangement may further comprise means for discharging separated ilmenite particles.

Preferably, the arrangement comprises at least one selector for pre-selecting particles in the at least one ash stream before passing the ash stream to the separator. The at least one selector may be a mechanical particle selector, preferably a sieve and/or a fluid driven particle selector, preferably a gas driven particle selector. This optional pre-selector is particularly advantageous when the fluidized bed boiler is operated with a fuel type, such as, e.g., waste, which leads to a high ash content (so-called high ash fuel), e.g. 20-30 wt-% ash with respect to the total weight of the fuel.

In the following, advantageous embodiments will be explained by way of example.

Figure 2:
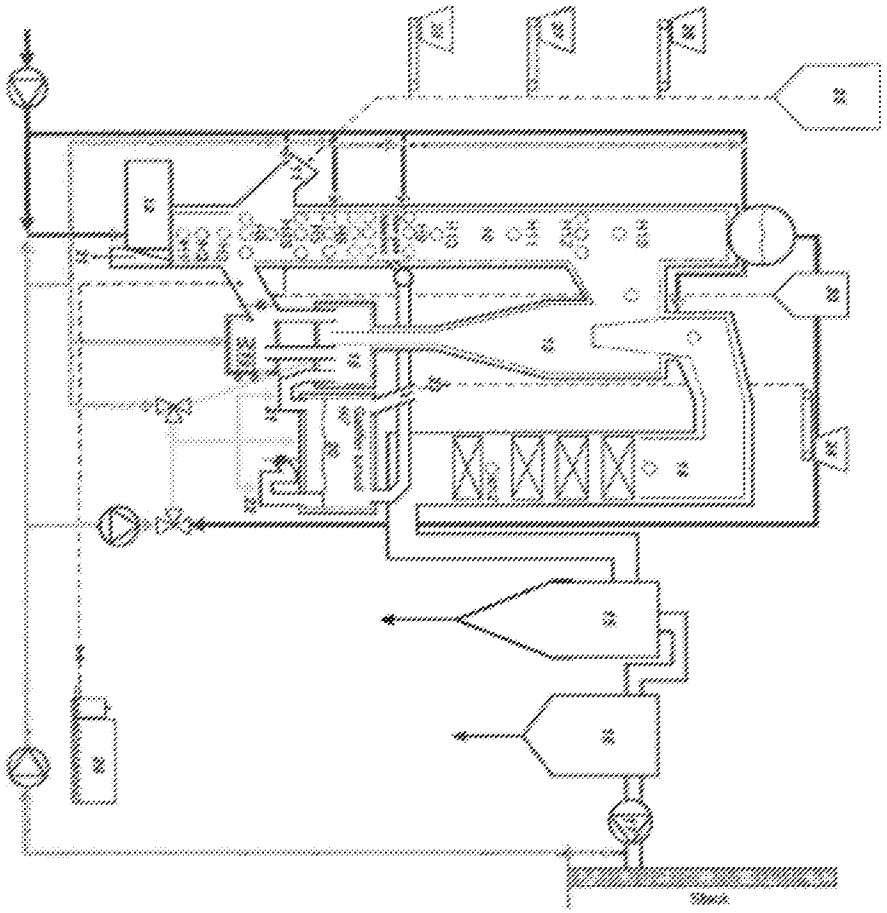
Figure 3:
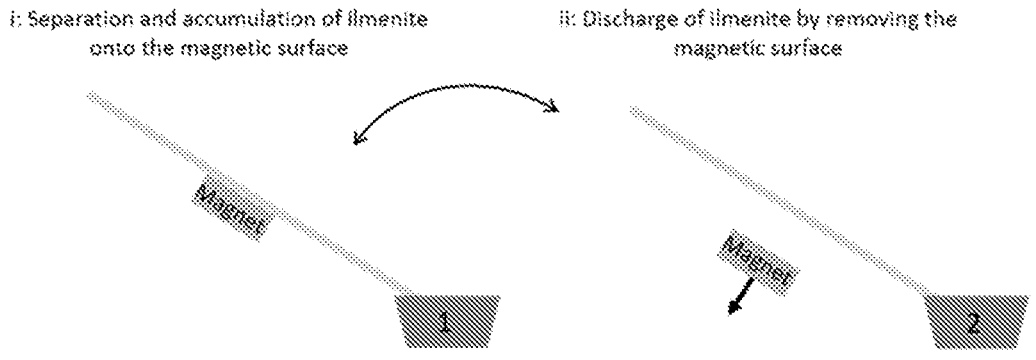
Figure 4:
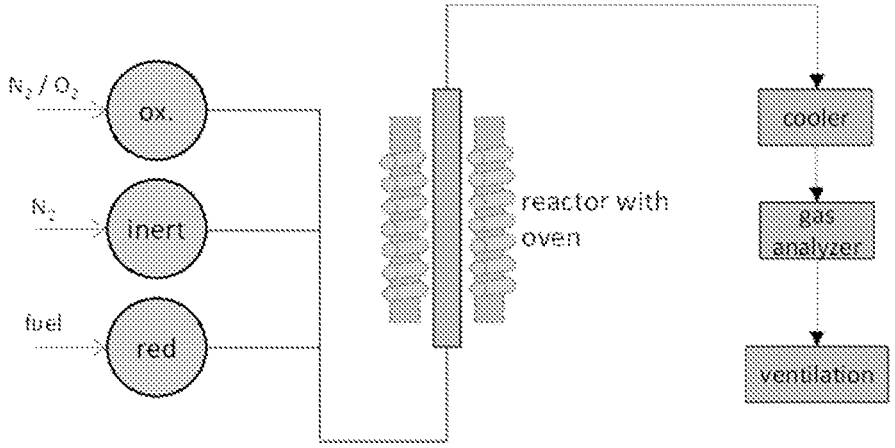
Figure 5:
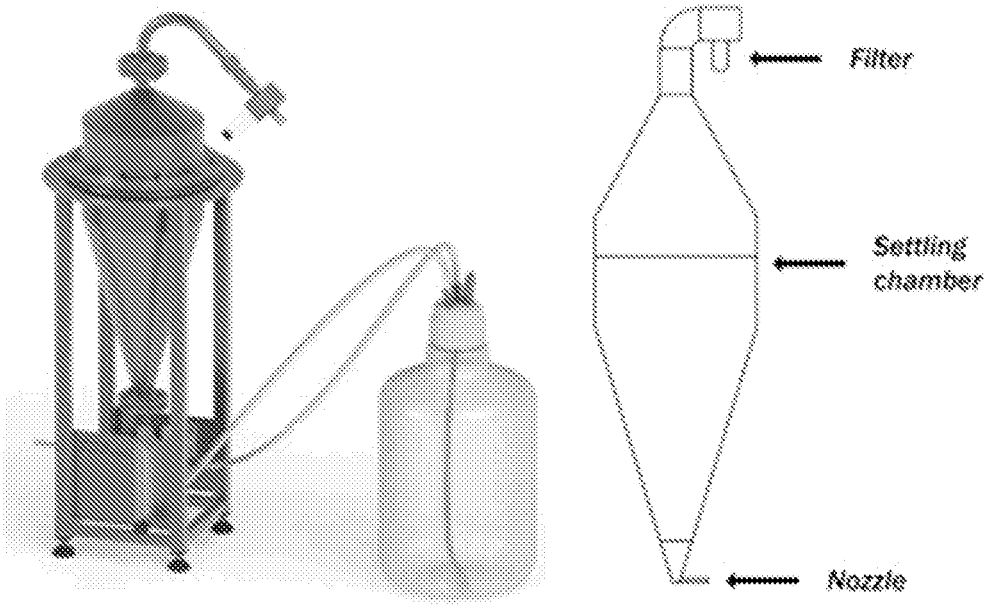
Figure 6:
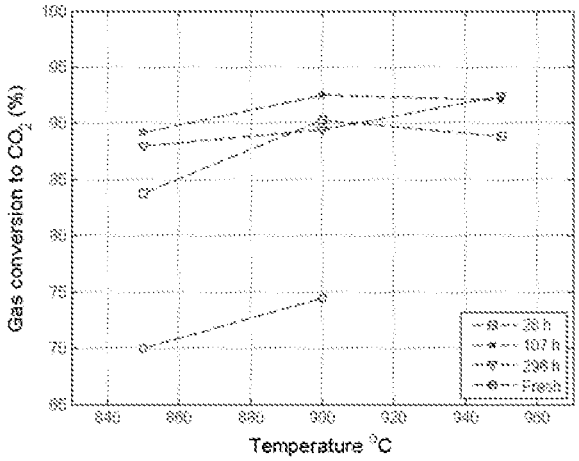
Figure 7:
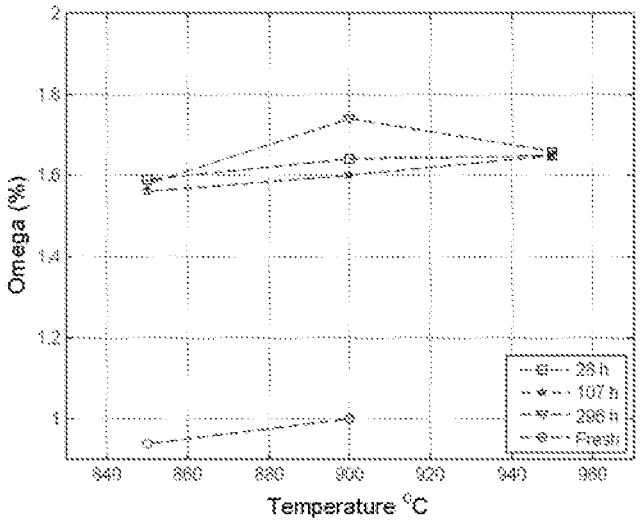
Figure 8:
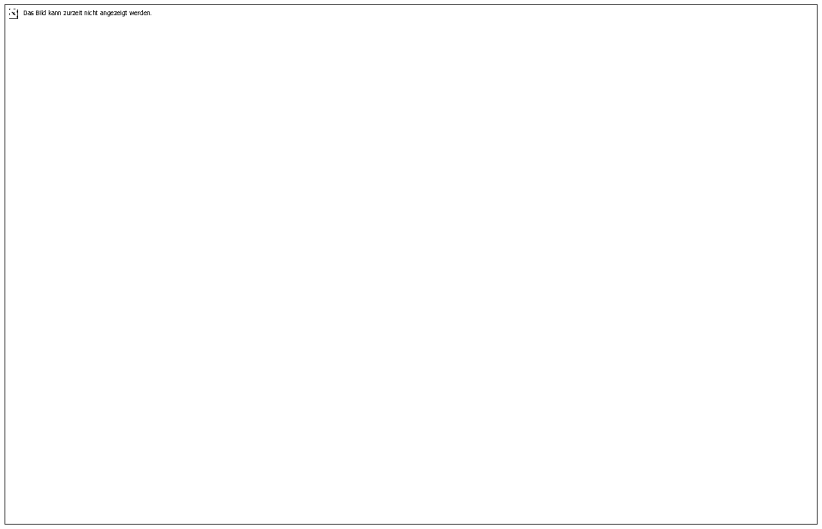
Figure 9:
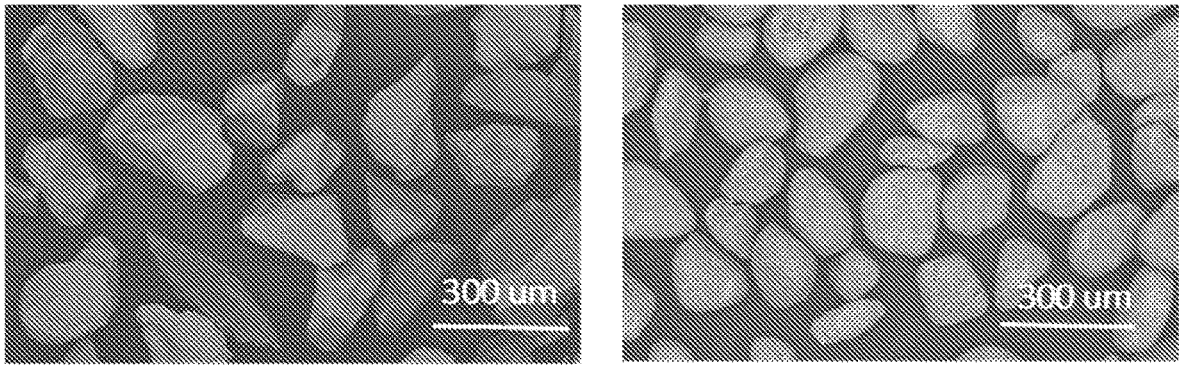
Figure 10:
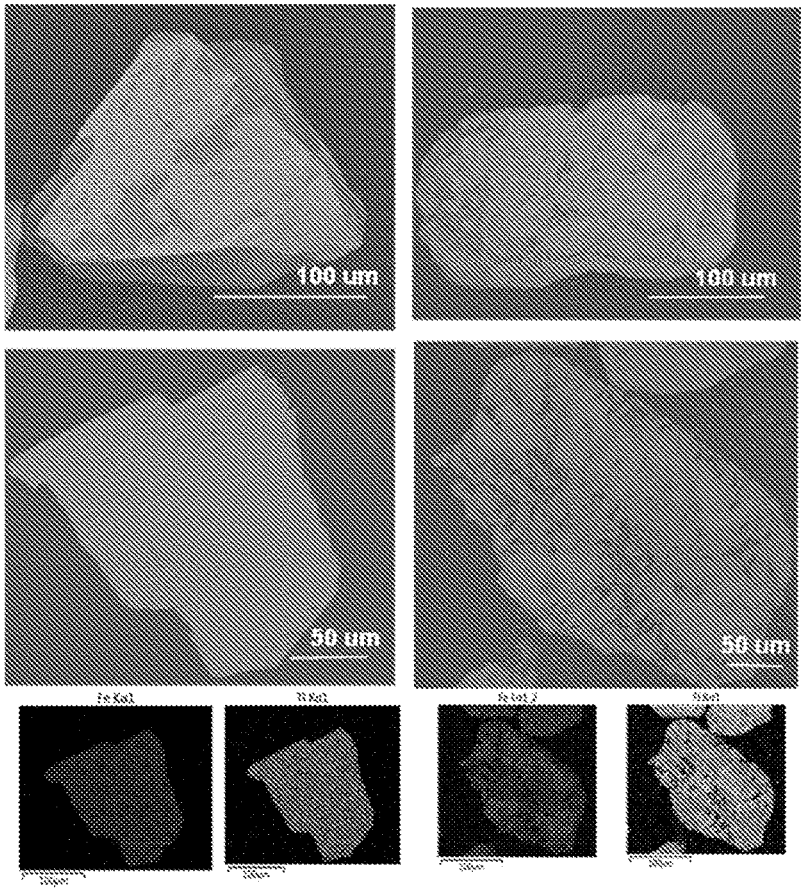
Figure 11:
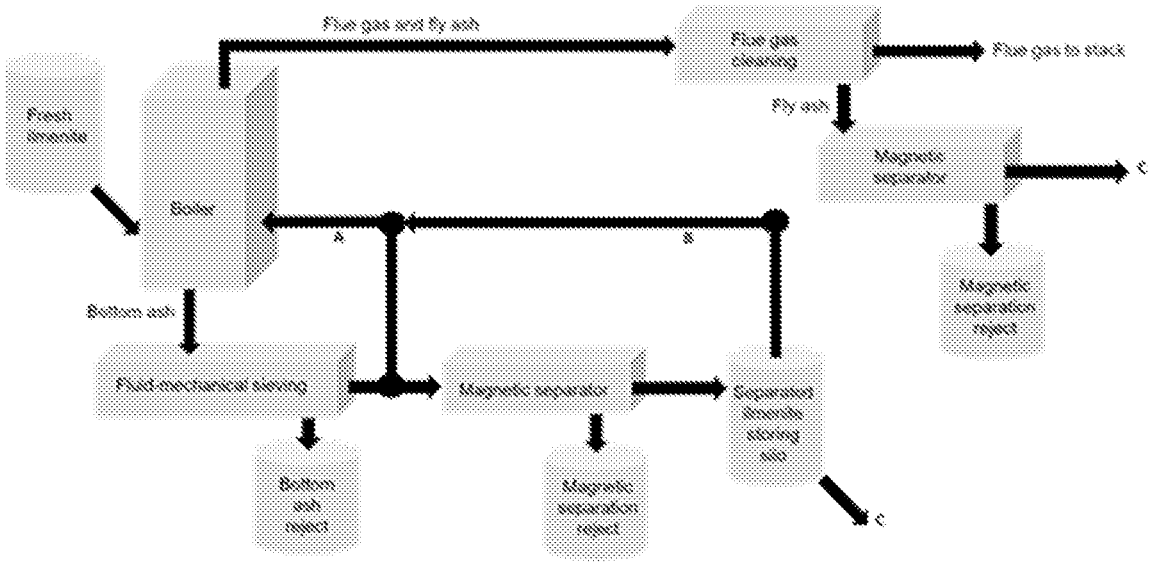
Figure 12:
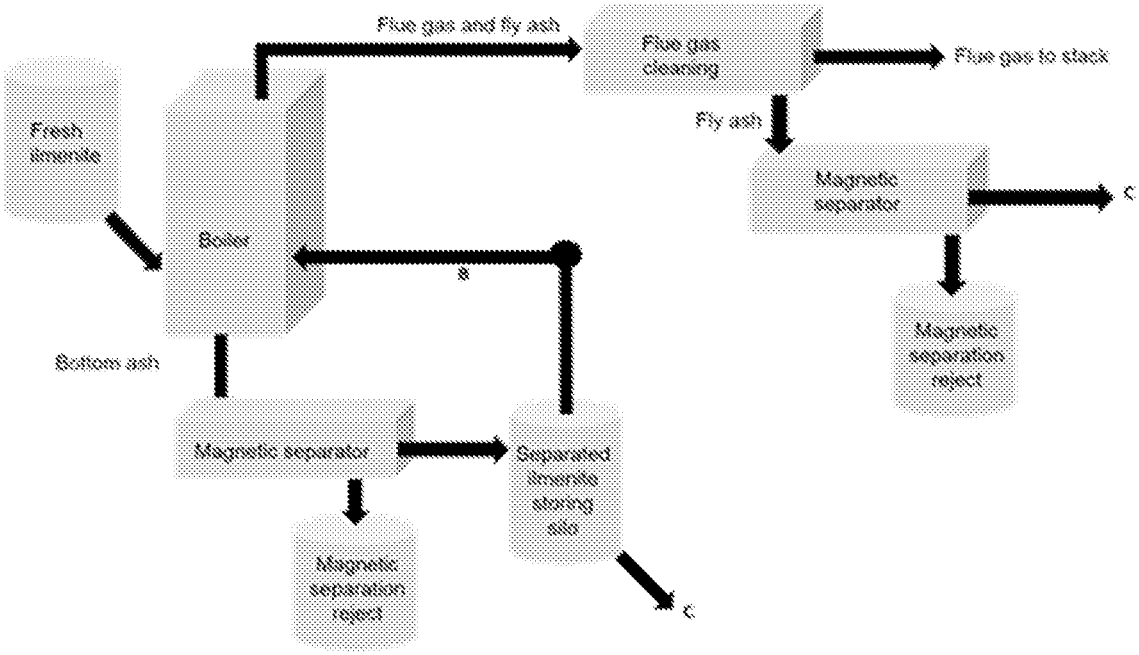
Figure 13:
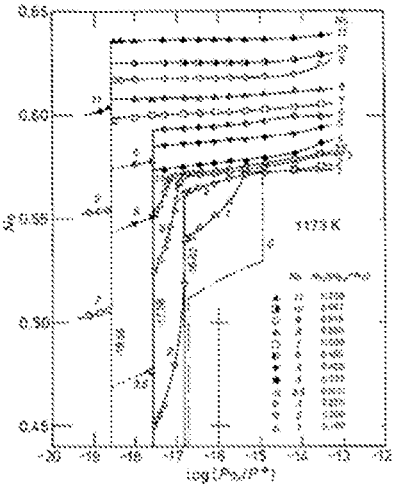
Figure 14:
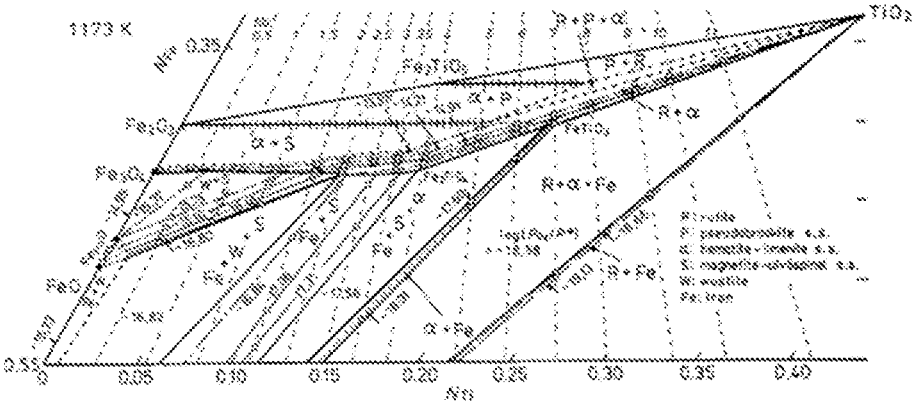
Figure 15:
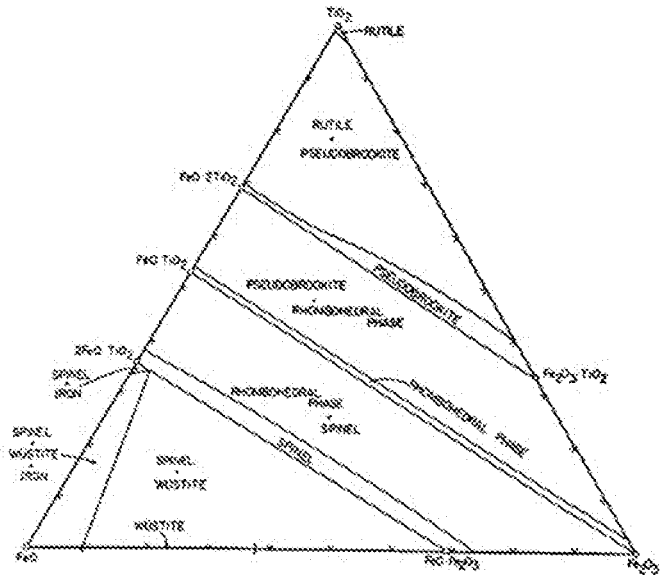

It is shown in:

FIG. 1: a schematic illustration of the outward diffusion of Fe and the formation of Fe-shell around ilmenite particles exposed to combustion conditions in a fluidized bed boiler;

FIG. 2; a schematic picture of the boiler and gasifier system at Chalmers University of Technology;

FIG. 3: a schematic picture of the procedure for separating ilmenite particles from ashes using bottom bed samples from a commercial fluidized bed boiler;

FIG. 4: a schematic picture of the lab scale reactor system employed for ilmenite tests;

FIG. 5: equipment for determining attrition rate of particles;

FIG. 6: average gas conversion of CO to $CO_2$ at 850, 900 and 950° C., for bed materials used within the Chalmers boiler and samples after 28 hours of operation, 107 hours of operation and 296 hours of operation and for fresh ilmenite particles activated in the lab reactor;

FIG. 7: average oxygen carrier mass-based conversion at 850, 900 and 950° C., for bed materials used within the Chalmers boiler and sampled after 28 hours of operation, 107 hours of operation and 296 hours of operation and for fresh ilmenite activated in the lab reactor;

FIG. 8: performance parameters used for mechanical strength evaluation for fresh ilmenite and the bed materials used within the Chalmers boiler and sampled after 28 hours of operation, 107 hours of operation and 296 hours of operation;

FIG. 9: electron micrographs of fresh ilmenite particles (left) and ilmenite particles that have been used as bed material in a CFB boiler after 24 h of operation (right);

FIG. 10: electron micrographs of ilmenite particles before (left) and after exposure exposure in a lab scale fluidized bed reactor (right); and FIG. 11: a schematic exemplary bed management cycle and corresponding arrangement;

FIG. 12: another schematic exemplary bed management cycle and corresponding arrangement;

FIG. 13: a phase diagram from FactSage computer calculations;

FIG. 14: a phase diagram from FactSage computer calculations;

FIG. 15: a phase diagram from FactSage computer calculations.

EXAMPLE 1

By way of example, FIGS. 11 and 12 show a schematic arrangement for carrying out fluidized bed combustion, wherein the arrangement is shown with an optional pre-selector (FIG. 11) and without an optional pre-selector (FIG. 12). The arrangement can be utilized for implementing the bed management cycle described herein.

The arrangement comprises a fluidized bed boiler, which may be, e.g. a BFB boiler or a CFB boiler. The boiler may be fed with fresh ilmenite particles as bed material. The arrangement further comprises a system for removing ash from the fluidized bed boiler, which is configured to remove bottom ash (via a bottom ash removal system) and fly ash (via a flue gas cleaning plant) as indicated. Furthermore, the arrangement comprises a magnetic separator for separating ilmenite particles from the removed bottom ash and a magnetic separator for removing ilmenite from the fly ash. Furthermore, the system comprises means (not shown) for recirculating ilmenite particles separated from the bottom ash into the bed of the fluidized bed boiler via Route B as indicated by the arrows. Preferably, the means for recirculating ilmenite particles comprise pneumatic recirculation systems, mechanical recirculation systems and/or magnetic recirculation systems. The exemplary arrangement further comprises means (not shown) for discharging separated ilmenite particles (via Route C indicated by the arrows), preferably for use in downstream applications where the need for activated ilmenite particles arises.

The arrangement also comprises an optional selector for pre-selecting particles using fluid-mechanical sieving, wherein pre-selection can be preferably based on particle size and/or mass. Route A (not according to the invention) indicates a potential recirculation path for bed material that has passed the pre-selector but is not fed to the (magnetic) separator and does not provide the benefits of the invention.

The arrangement may be utilized for implementing the bed management cycle described above. In particular, the bed management cycle may comprise the steps of:

a) providing fresh ilmenite particles as bed material to the fluidized bed boiler;
b) carrying out a fluidized bed combustion process;
c) removing at least one ash stream comprising ilmenite particles from the fluidized bed boiler;
d) separating ilmenite particles from the at least one ash stream;
e) recirculating separated ilmenite particles into the bed of the fluidized bed boiler.

In this example, the removal of the bottom ash stream and the fly ash stream is shown, as well as magnetic separation of ilmenite particles from the two ash streams. Step e) is carried out on ilmenite particles removed from the bottom ash stream, wherein it is possible to recirculate a first fraction of the separated ilmenite particles into the boiler via route B and to discharge a second fraction of the separated ilmenite particles via route C. Separation and or recirculation of the ilmenite particles may be carried out based on the degree of activation of the ilmenite particles, by using the magnetic susceptibility of the ilmenite particles as a proxy for the degree of activation and setting the appropriate magnetic threshold levels, accordingly.

The bed management cycle may further comprise an optional pre-selection step, in which the particles in the bottom ash stream are pre-selected using fluid-mechanical sieving before magnetically separating the ilmenite particles from the ash stream.

The average residence time of the ilmenite particles in the fluidized bed boiler may preferably be set to at least 75 hours, further preferably at least 100 hours, further preferably at least 120 hours, further preferably at least 200 hours, further preferably at least 250 hours, further preferably at least 290 hours, most preferably at least 300 hours; and/or preferably less than 600 hours, further preferably less than 500 hours, further preferably less than 400 hours, further preferably less than 350 hours.

Preferably, the feeding rate of fresh ilmenite particles is decoupled from the ash removal rate, preferably from the bottom ash removal rate.

The exemplary bed management cycle may further comprise controlling the ilmenite concentration in the bed; wherein preferably the ilmenite concentration is kept within a predetermined range; wherein the ilmenite concentration range in the bed is preferably 10 wt. % ato 95 wt %, more preferably 50 wt.-% to 95 wt. %, most preferably 75 wt.-% to 95 wt.-%.

EXAMPLE 2

The Chalmers 12 $MW_{th}$ CFB-boiler is shown in FIG. 2. Reference numerals denote:

10 furnace
11 fuel feeding (furnace)
12 wind box
13 cyclone
14 convection path
15 secondary cyclone
16 textile filter
17 fluegas fan
18 particle distributor
19 particle cooler
20 gasifier
21 particle seal 1
22 particle seal 2
23 fuel feeding (gasifier)
24 fuel hopper (gasifier)
25 hopper
26 fuel hopper 1
27 fuel hopper 2
28 fuel hopper 3
29 sludge pump
30 hopper
31 ash removal
32 measurement ports A 300 hour long combustion experiment using rock ilmenite as bed material was conducted in the Chalmers 12 $MW_{th}$ CFB boiler, FIG. 2. The boiler was operated using wood-chips as fuel and the temperature in the boiler was kept around 830-880° C. during the experiment. No discharge of the ilmenite in the form of bottom bed regeneration was carried out during the whole experiment, this is different compared to operation with ordinary silica sand where around 10-15 wt. % of the bed is discharged and replaced with fresh silica sand on a daily basis.

Fresh ilmenite was fed only to compensate for the fly ash losses. Samples of the bed material were collected in location H2 by using a water-cooled bed sampling probe, after 28, 107 and 296 hours. These samples were further evaluated in a lab-scale fluidized bed reactor system (see example 3).

EXAMPLE 3

Three samples of bottom bed from the Chalmers boiler (see Example 2) were chosen for the evaluation. The samples were collected in the combustor after 28, 107 and 296 hours of operation. All samples were tested separately in a lab-scale fluidized bed reactor in a cyclic mode according to the below-described principle of altering the environment between oxidizing and reducing environment. In addition to the three samples from the Chalmers boiler, fresh ilmenite particles from the same mine (Titania A/S) were tested as a reference. In this case, the activation of the ilmenite was conducted within the lab-scale reactor and the time period represents around 20 cycles. In the lab-scale reactor system the exposure time for the ilmenite is referred to as cycles meanwhile the exposer time with in a combustor would be referred to as minutes or hours. A rather harsh and conservative correlation between the cycles in the lab-scale reactor system and the residence time would be that 20 cycles within the reactor system corresponds to 1 hour of operation in a conventional FBC boiler.

With regards to the chemical impact and the chemical aging of ilmenite, the oxygen-carrying properties of the ilmenite and its reactivity towards oxidizing carbon monoxide (CO) into carbon dioxide ($CO_2$) have been examined.

The evaluation of the reactivity and oxygen transfer is based on experimental tests performed in a lab-scale fluidized reactor system, shown schematically in FIG. 4. All experiments are carried out in a fluidized bed quartz glass reactor with an inner diameter of 22 mm and an overall length of 870 mm. A porous quartz plate is mounted in the centre of the reactor and serves as gas distributor. The sample is weighed before the experiment and placed on the quartz plate at ambient conditions. 10-15 g of material with a particle size fraction of 125-180 μm is used.

Temperatures of 850, 900 and 950° C. have been investigated in the present study. The temperature is measured by a type K CrAl/NiAl thermocouple. The tip of the thermocouple is located about 25 mm above the porous plate to make sure that it is in contact with the bed when fluidization occurs. The thermocouple is covered by a quartz glass cover, protecting it from abrasion and the corrosive environment. The reactor is heated by an external electrical oven.

During heating and oxidation, the particles are exposed to a gas consisting of 21 vol. % $O_2$ diluted with nitrogen ($N_2$). After the desired temperature has been reached, the gas atmosphere is shifted from oxidizing to reducing conditions by changing the ingoing gas. In order to prevent combustion of fuel by oxygen from the oxidation phase as well as to prevent reduction gas in the beginning of the oxidation phase, both phases are separated by a 180 s inert period. During the inert period the reactor is flushed with pure nitrogen. The fuel gases as well as synthetic air are taken from gas bottles whereas the nitrogen ($N_2$) is supplied from a centralized tank. The fluidizing gas enters the reactor from the bottom. The gas composition is controlled by mass flow controllers and magnetic valves. The water content in the off gas is condensed in a cooler before the concentrations of CO, $CO_2$, $CH_4$, $H_2$ and $O_2$ are measured downstream in a gas analyser (Rosemount NGA 2000).

The reactivity of the materials as oxygen carriers were assessed through two main performance parameters—the oxygen carrier conversion)(ω) and the resulting gas conversion($\gamma_i^-$).

The conversion of the oxygen carrier is described by its mass-based conversion ω, according to $$\omega = \frac{m}{m_{ox}}$$

where m denotes the actual mass of the oxygen carrier and $m_{ox}$ is the mass of the oxidized oxygen carrier. It is assumed that the changes in the mass of the oxygen carrier originate only from the exchange of oxygen.

The oxygen carrier mass-based conversion is calculated as a function of time t from the mass balance of oxygen over the reactor:

$$syngas:\ \omega_t = \omega_{t-1} - \int_{t-1}^{t} \frac{\dot{n}^- M_O}{m_{ox}} \cdot (2y_{CO2}^- + y_{CO}^- - y_{H2}^- + 2y_{O2}^-)dt$$

$\dot{\eta}^-$ is the molar flow rate at the reactor outlet and $M_O$ the molar mass of oxygen.

The gas conversion $\gamma_{CO}$ for syngas is defined as follows:

$$\gamma_{CO} = \frac{y_{CO2}^-}{y_{CO2}^- + y_{CO}^-}$$

$\gamma_i^-$ is the molar fraction of the components in the effluent gas stream. In order for ilmenite to reach its maximum performance it needs to be activated through several consecutive redox cycles. Therefore, the number of cycles needed for activation was also used as a performance parameter for choice of material as this number is indicative for the time point when the oxygen carrier reaches its full potential. In a CFB boiler the activation occurs naturally since the particles meet alternating reducing/oxidizing environments while circulating in the CFB loop.

FIG. 6 show the gas conversion of CO into $CO_2$ for three temperatures for the lab-scale experiments using the three bottom bed samples from the Chalmers boiler (Example 2) and for two temperatures for fresh ilmenite that was activated in the lab-scale reactor.

The lower line in FIG. 6 represents the experiments with the fresh ilmenite. The experiments using the three bottom bed samples collected at different times in the Chalmers give much higher gas conversion of CO to $CO_2$ than what was expected. In fact, the gas conversion for these samples are 15%-units higher than the one with the fresh ilmenite used as reference. The relatively good agreement in gas conversion between the three samples from the Chalmers boiler clearly highlights the effects initiated from long term operation in a FBC-boiler.

Overall, these data show the surprising result that the ilmenite could be used for at least 300 hours in a combustor. As the gas conversion is still much higher than for fresh particles after 300 hours the results indicate that it is possible to extend the residence time of the ilmenite particles significantly longer.

FIG. 7 shows the average oxygen carrier mass-based conversion for three temperatures for the lab-scale experiments using the three bottom bed samples from the Chalmers boiler (Example 2) and for two temperatures for the fresh ilmenite that was activated in the lab-scale reactor.

Again, the lower line in FIG. 7 represents the experiments with the fresh ilmenite. The Omega number for the three bottom bed samples from the Chalmers boiler is much higher than expected. The discovery in increased gas conversion agrees well with the increase in oxygen transfer and the omega number and the gas conversion is therefore supporting each other.

These experiments show that the ilmenite particles can be used as oxygen-carrier even after having been exposed to boiler conditions for an extended period of time, ranging up to at least 300 hours. The data further provide evidence that it is possible to recirculate used ilmenite particles into the boiler multiple times for an extended period of time as the recirculated ilmenite particles will still have very good oxygen-carrying properties.

EXAMPLE 4A

The samples from the Chalmers boiler obtained in Example 2 and the fresh ilmenite were also tested in an attrition rig as described below.

Attrition index was measured in an attrition rig that consists of a 39 mm high conical cup with an inner diameter of 13 mm in the bottom and 25 mm in the top, see FIG. 5. At the bottom of the cup through a nozzle with an inner diameter of 1.5 mm (located at the bottom of the cup) air is added at a velocity of 10 l/min. Prior to the experiments the filter is removed and weighed. The cup is then dismantled and filled with 5 g of particles. Both parts are then reattached and the air flow is turned on for 1 hour. In order to get the development of fines during the attrition tests the air flow is stopped at chosen intervals and the filter is removed and weighed.

FIG. 8 shows the results from the attrition experiments for the experiments using the three bottom bed samples from the Chalmers boiler (see Example 2) and fresh ilmenite. FIG. 8 shows the surprising result that after an extended residence time of the particles in the boiler the rate of attrition for the particles decreases. This suggests that the mechanical strength of the particles is sufficient for recycling even after 296 hours in a fluidized bed boiler.

EXAMPLE 4B

FIG. 9 shows electron micrographs of fresh rock ilmenite particles and rock ilmenite particles that have been exposed to a redox environment in the Chalmers CFB boiler for 24 hours.

The exposed rock ilmenite particles have smoother edges and are likely to produce less fines. Without wishing to be bound by theory, it is contemplated that this phenomenon is likely coupled to the particles being exposed to friction in between particles and boiler walls resulting in a much smoother and round surface than the fresh particles. The increased roundness leads to a less erosive surface which is less abrasive to the walls of the boiler.

EXAMPLE 5

FIG. 10 shows electron micrographs of ilmenite particles before and after exposure in a lab scale fluidized bed reactor, an overview of the cross-section and elemental maps of Iron (Fe) and Titanium (Ti) are shown for both cases. The overview of the particles (top) shows once again that the exposed particles become less sharp. From the micrographs (center) it can also be confirmed that the porosity of the particles increases with exposure, with some of the particles having multiple cracks in their structure. The elemental mapping (bottom, right) shows that the Fe and the Ti fraction is homogeneously spread within the fresh ilmenite particles. In comparison to the fresh particles the exposed ones (bottom, left) clearly indicate that the Fe is migrating towards the surface of the ilmenite particles while the Ti fraction is more homogeneously spread in the particle. The iron migration is schematically indicated in FIG. 1 and a desired mechanism since the invention has recognized that this increases the possibilities for efficient separation of the ilmenite particles by a magnetic process.

EXAMPLE 6

Magnetic separation was evaluated using bottom bed samples from an industrial scaled boiler operated with ilmenite as bed material. The 75 $MW_{th}$ municipal solid waste fired boiler was operated using ilmenite as bed material during more than 5 months. Several bottom bed samples were collected during this operating time. The fuel that is fed to this boiler commonly comprises 20-25 wt. % non-combustibles in the form of ash and the regeneration of the bottom bed is thereby a continuous process to keep the differential pressure over the bed sufficient.

The potential of separating the ilmenite from the ash fraction was investigated for six arbitrary samples collected during the operation of the boiler. A 1 meter long half pipe made from a steel plate was used together with a magnet as indicated in FIG. 3. The magnet was placed on the backside of the halfpipe and the halfpipe was tilted in a ≈45° angel with the bottom end resting in a metal vessel (1). (i), A portion of the sample, roughly 10-15 g, was poured into the halfpipe and the material was allowed to flow across the metal surface by gravity. When the material flowed across the surface where the magnet was acting on the steel plate, the ilmenite was captured and the ash fraction passed by and was captured in the metal vessel (1). (ii), The half pipe was moved to the metal vessel (2) and the magnet was removed and the ilmenite fraction was captured in the vessel (2).

Furthermore, magnetic separation of ilmenite particles and ash has been successfully tested for rock and sand ilmenite with the Chalmers boiler.

EXAMPLE 7

FIGS. 13, 14 and 15 show phase diagrams from FactSage calculations. Such diagrams show which compounds and phases of the compounds are stable under the conditions given in the calculation. FIG. 13 shows the composition versus the gaseous oxygen concentration at the temperature 1173 K, which is the normal combustion temperature in FB boilers. FIG. 14 shows the stable compounds and phases of Fe, Ti and O versus the concentration of Fe and Ti, also at 1173 K. FIG. 15 shows the stable compounds and phases between the pure oxides; FeO, $TiO_2$, and $Fe_2O_3$. For example, at high concentration of oxygen and no Ti, the stable compound is $Fe_2O_3$. At reducing condition (=low oxygen concentration) and no Ti, the stable compound is FeO.

The invention claimed is:

1. A process for bed management for a fluidized bed boiler, the process comprising the steps of:

a) providing fresh ilmenite particles as bed material to the bed of a fluidized bed boiler;

b) carrying out a fluidized bed combustion process with the fluidized bed boiler, wherein air is passed from below the bed through the bed material;

c) removing at least one ash stream comprising ilmenite particles from the fluidized bed boiler;

d) separating ilmenite particles from the at least one ash stream;

e) recirculating separated ilmenite particles into the bed of the fluidized bed boiler, wherein a first fraction of the separated ilmenite particles is recirculated into the bed of the fluidized bed boiler, and a second fraction of the separated ilmenite particles is discharged, wherein the first fraction and the second fraction are determined based on the degree of activation of the ilmenite particles;

wherein the average residence time of the ilmenite particles in the fluidized bed boiler is at least 75 hours; and wherein separating ilmenite particles comprises magnetic separation.

2. The process of claim 1, characterized in that separating ilmenite particles comprises electric separation.

3. The process of claim 1, characterized in that steps c), d) and e) are carried out multiple times.

4. The process of claim 1, characterized by one or more of the following features:

the at least one ash stream is selected from the group consisting of bottom ash stream, fly ash stream, boiler ash stream, and filter ash stream;

the fluidized bed boiler is a bubbling fluidized bed boiler or a circulating fluidized bed boiler.

5. The process of claim 1, further comprising a pre-selection step in which particles in the at least one ash stream are pre-selected before separating the ilmenite particles from the ash stream.

6. The process of claim 1, characterized in that fresh ilmenite particles are provided at a feeding rate and ash is removed at an ash removal rate, wherein the feeding rate of fresh ilmenite particles is decoupled from the ash removal rate.

7. The process of claim 1, wherein ilmenite particles in the bed are kept within a predetermined concentration range.

8. A fluidized bed combustion system comprising a fluidized bed boiler comprising ilmenite particles having an average residence time of at least 75 hours as bed material in the bed of the fluidized bed boiler wherein air is passed from below the bed through the bed material; and an ash removal system;

characterized in that the fluidized bed combustion system comprises a) a separator for separating ilmenite particles from removed ash; wherein the separator comprises a magnetic separator and b) a recirculation system for recirculating separated ilmenite particles into the bed of the fluidized bed boiler; wherein a first fraction of the separated ilmenite particles is recirculated into the bed of the fluidized bed boiler, and a second fraction of the separated ilmenite particles is discharged, wherein the first fraction and the second fraction are determined based on the degree of activation of the ilmenite particles.

9. The fluidized bed combustion system of claim 8, characterized by one or more of the following features:

the separator comprises an electric separator;

the-ash removal system-removes bottom ash and/or fly ash and/or boiler ash and/or filter ash;

the recirculation system is selected from the group consisting of pneumatic recirculation systems, mechanical recirculation systems and magnetic recirculation systems;

the fluidized bed boiler is a bubbling fluidized bed boiler or a circulating fluidized bed boiler.

10. The fluidized bed combustion system of claim 8, further comprising a discharge system for discharging separated ilmenite particles.

11. The fluidized bed combustion system of claim 8, further comprising at least one selector for pre-selecting particles in the at least one ash stream before passing the ash stream to the separator.

12. The process of claim 2, wherein the electric separation comprises electrostatic separation.

13. The process of claim 3, characterized in that carrying out steps c), d), and e) multiple times provides continuous recirculation of separated ilmenite particles into the bed of the fluidized bed boiler.

14. The process of claim 1, characterized in that the first and second fractions are determined based on the the particle size of the separated ilmenite particles.

15. The process of claim 5, wherein the pre-selection of particles in the at least one ash stream comprises at least one of:

mechanical particle separation sieving fluid-driven particle separation gas-driven particle separation.

16. The process of claim 1, wherein an average residence time for ilmenite particles in the fluidized bed boiler is less than 600 hours.

17. The process of claim 16, wherein an average residence time for ilmenite particles in the fluidized bed boiler is between 100 hours to 500 hours.

18. The process of claim 7, wherein the concentration of ilmenite particles in the bed material is kept within a concentration range of 10 wt. % to 95 wt %.

19. The process of claim 7, wherein the concentration of ilmenite particles in the bed material is kept within a concentration range of 50 wt. % to 95 wt %.

20. The process of claim 7, wherein the concentration of ilmenite particles in the bed material is kept within a concentration range of 75 wt. % to 95 wt %.

21. The fluidized bed combustion system of claim 9, wherein the electric separator comprises an electrostatic separator.

22. The fluidized bed combustion system of claim 11, wherein the at least one selector comprises one or more of:

a mechanical particle selector a sieve a fluid-driven particle selector a gas-driven particle selector.

23. The process of claim 1, wherein the separated ilmenite particles are recirculated to the fluidized bed boiler without reactor processing.

* * * * *